United States Patent [19]

Serra et al.

[11] Patent Number: 5,029,509

[45] Date of Patent: Jul. 9, 1991

[54] MUSICAL SYNTHESIZER COMBINING DETERMINISTIC AND STOCHASTIC WAVEFORMS

[75] Inventors: Xavier Serra, San Anselmo; Julius Smith, Palo Alto, both of Calif.

[73] Assignee: Board of Trustees of the Leland Stanford Junior University, Stanford, Calif.

[21] Appl. No.: 431,594

[22] Filed: Nov. 3, 1989

Related U.S. Application Data

[63] Continuation-in-part of Ser. No. 350,114, May 10, 1989, abandoned.

[51] Int. Cl.[5] ..... G10H 1/057; G10H 1/08; G10H 1/12

[52] U.S. Cl. ..... 84/625; 84/627; 84/DIG. 9

[58] Field of Search ..... 84/622, 623, 625, 627, 84/DIG. 9, 659–661, 663

[56] References Cited

U.S. PATENT DOCUMENTS 4,114,498 9/1978 Chibana et al. ..... 84/622
4,466,325 8/1984 Takauji ..... 84/623
4,502,361 3/1985 Viitanen et al. .
4,700,603 10/1987 Takauji et al. ..... 84/622

FOREIGN PATENT DOCUMENTS 0285276 9/1978 European Pat. Off. .
WO86/05617 9/1986 PCT Int'l Appl. .
WO89/09985 10/1989 PCT Int'l Appl. .

*Primary Examiner*—Stanley J. Witkowski
*Attorney, Agent, or Firm*—Flehr, Hohbach, Test, Albritton & Herbert

[57] ABSTRACT

A musical sound analyzer and synthesizer uses a model that considers a sound to be composed of two types of elements: a deterministic component plus a stochastic component. The deterministic component is represented as a series of sinusoids, with an amplitude and a frequency function for each sinusoid. The stochastic component is represented as a series of magnitude spectral envelopes. From this representation, sounds can be synthesized that, in the absence of modifications, can behave as perceptual identities, that is, they are perceptually equal to the original sound. In addition, stored representations of sounds can be easily modified in a musical synthesizer to create a wide variety of new sounds.

17 Claims, 5 Drawing Sheets

MUSICAL SYNTHESIZER COMBINING DETERMINISTIC AND STOCHASTIC WAVEFORMS

This application is a continuation in part of application Ser. No. 07/350,114, filed May 10, 1989 and now abandoned.

The present invention relates generally to musical synthesizers and particularly to methods and systems for analyzing sound signals and for synthesizing new sound signals.

BACKGROUND OF THE INVENTION

A shortcoming of prior art musical synthesizers is that such synthesizers generally try to use a single model to represent all musical sounds. It is very difficult to get a single model to faithfully represent the wide range of musical sounds. It is also important to provide a model for representing sounds which makes it possible and practical to reproduce and transform the sounds generated by the synthesizer. The present invention uses a model with two very different types of elements to represent two different aspects of musical sounds.

SUMMARY OF THE INVENTION

In summary, the present invention is a musical sound analyzer and synthesizer which is based on a model that considers a sound to be composed of two types of elements: a deterministic component plus a stochastic component. The deterministic component is represented as a series of sinusoids, with an amplitude and a frequency function for each sinusoid. The stochastic component is represented as a series of magnitude spectral envelopes. From this representation sounds can be synthesized that, in the absence of modifications, can behave as perceptual identities, that is, they are perceptually equal to the original sound. In addition, stored representations of sounds can be easily modified in a musical synthesizer to create a wide variety of new sounds.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

The present invention's analysis and synthesis technique is based on the short-time Fourier transform (STFT), from which the relevant magnitude peaks are detected and assigned to a number of frequency trajectories. The deterministic component is obtained from these trajectories with an additive synthesis technique.

More specifically, the deterministic component is a set of sound partials which represent the deterministic component of a limited time sample of the waveform being analyzed.

Then, in order to obtain the stochastic component, the spectra of the deterministic component are subtracted from the spectra of the original waveform. The result is a residual spectra which, in turn, can be approximated by a series of amplitude envelopes. These envelopes represent the stochastic component. When synthesizing new sounds, the stochastic component is synthesized by multiplying the spectrum of white noise with these frequency envelopes and performing an inverse-STFT.

The model used by the present invention assumes that the input sound s(t) is the sum of a series of sinusoids plus a noise signal e(t):

$$s(t) = \sum_{r=1}^{R} A_r(t)\cos\{\theta_r(t)\} + e(t) \qquad \text{(Eq. 1)}$$

where $A_r(t)$ and $\theta_r(t)$ are the instantaneous amplitude and phase of each sinusoid and e(t) is the noise signal. R is the number of sinusoids used in the series to represent the sound.

The model used in the present invention also assumes that the sinusoids are stable partials of the sound s(t) and that each one can be characterized by its amplitude and frequency. The instantaneous phase is then taken to be the integral of the instantaneous frequency $\omega_r(t)$, and therefore satisfies $$\theta_r(t) = \int_0^t \omega_r(\sigma)d\sigma \qquad \text{(Eq. 2)}$$

where $\omega(t)$ is the frequency in radians, and r is the sinusoid number.

The residual e(t) in Equation 1 is also simplified by assuming it is a stochastic signal. Such an assumption allows us to model the residual as filtered white noise:

$$e(t) = \int_0^t h(t-\tau)u(\tau)d\tau \qquad \text{(Eq. 3)}$$

where u(t) is white noise and h(t) is the impulse response of a slowly time varying filter. That is, the residual is modeled by the convolution of white noise with a frequency shaping filter.

The analysis, transformation and synthesis techniques of the present invention are based on the above model which combines deterministic and stochastic elements for representing sounds.

Figure 1:
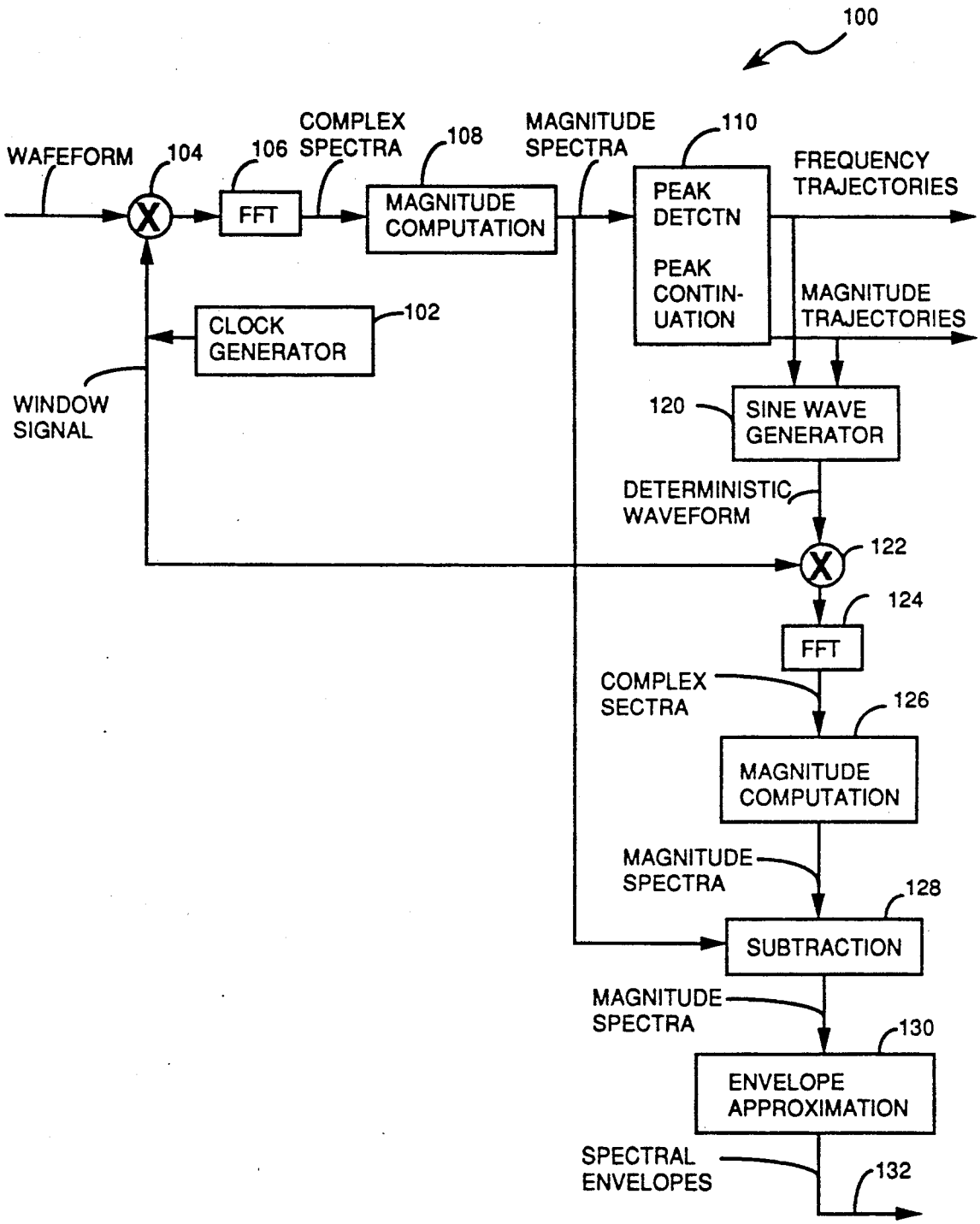
FIG. 1 is a block diagram of a musical sound analyzer in accordance with the present invention.

FIG. 1 shows a sound analyzer 100 in accordance with the present invention. The first step in analyzing a sound signal is to break it into a series of time frames, sometimes called windows. In particular, a clock generator 102 generates a sequence of window signals which are used by gate 104 to divide the sound waveform into separate time frames. The time frames are analyzed by a fast Fourier Transformer (FFT) so as to generate a set of complex spectra values. The FFT 106 uses the short-time Fourier Transform because this technique uses relatively short time frames (e.g. 50 milliseconds per time frame).

When computing the Fourier Transform, a "Kaiser window" is used to smooth the outer edges of each time frame. The length (i.e., duration) of the windows depends on the lowest frequency $\omega_r(t)$ that is being tracked. In particular, the window has a duration of at least four or five cycles of the lowest frequency that is to be tracked —in order to accommodate for the time-frequency trade-off associated with STFT. Furthermore the size of the sample buffer used by the STFT should be at least double the size of the window (i.e., double the number of samples collected during each window) because a big "zero-padding" in the buffer improves the performance of the technique.

A complex to real number converter 108 converts the complex spectra generated by the FFT 106 into a set of magnitude spectra for each time frame.

A peak detector and sound partial analyzer 110 finds the highest peaks in the magnitude spectra and performs a parabolic interpolation to refine the frequency and amplitude values generated. Each identified peak has a frequency and a magnitude value. The peaks from a series of time frames are then organized into pairs of frequency and magnitude trajectories, each pair of which represents a sound partial. Thus the analyzer 110 extracts the stable sinusoids present in the original sound (the deterministic component). The frequency and magnitude trajectories are typically stored for use in a music synthesizer, as will be described below.

The stochastic part of the waveform is generated as follows. First, the deterministic component of the original waveform is regenerated from the frequency and magnitude trajectories by reversing the process that was used to generate them. In particular, a sinewave generator 120 converts the frequency and magnitude trajectories into a "deterministic waveform".

The deterministic waveform is then gated by gate 122 with the window signals from clock generator 102. The Fourier Transform of the deterministic waveform is then generated by a fast Fourier Transform 124 using the same STFT technique as was used to analyze the original waveform. Thus the FFT 124 generates a set of complex spectra, which are converted in to magnitude spectra by a complex to real number converter 126. The magnitude spectrum of the deterministic signal is then subtracted from the magnitude spectrum of the original waveform by subtractor 128, yielding a residual spectrum.

Finally, an envelope generator 130 generates a line segment approximation 132 of the residual signal's spectral envelope—i.e., the envelope of the residual power spectrum output by the magnitude spectra subtractor 128. These envelopes represent the stochastic signal portion of the original waveform.

Figure 2:
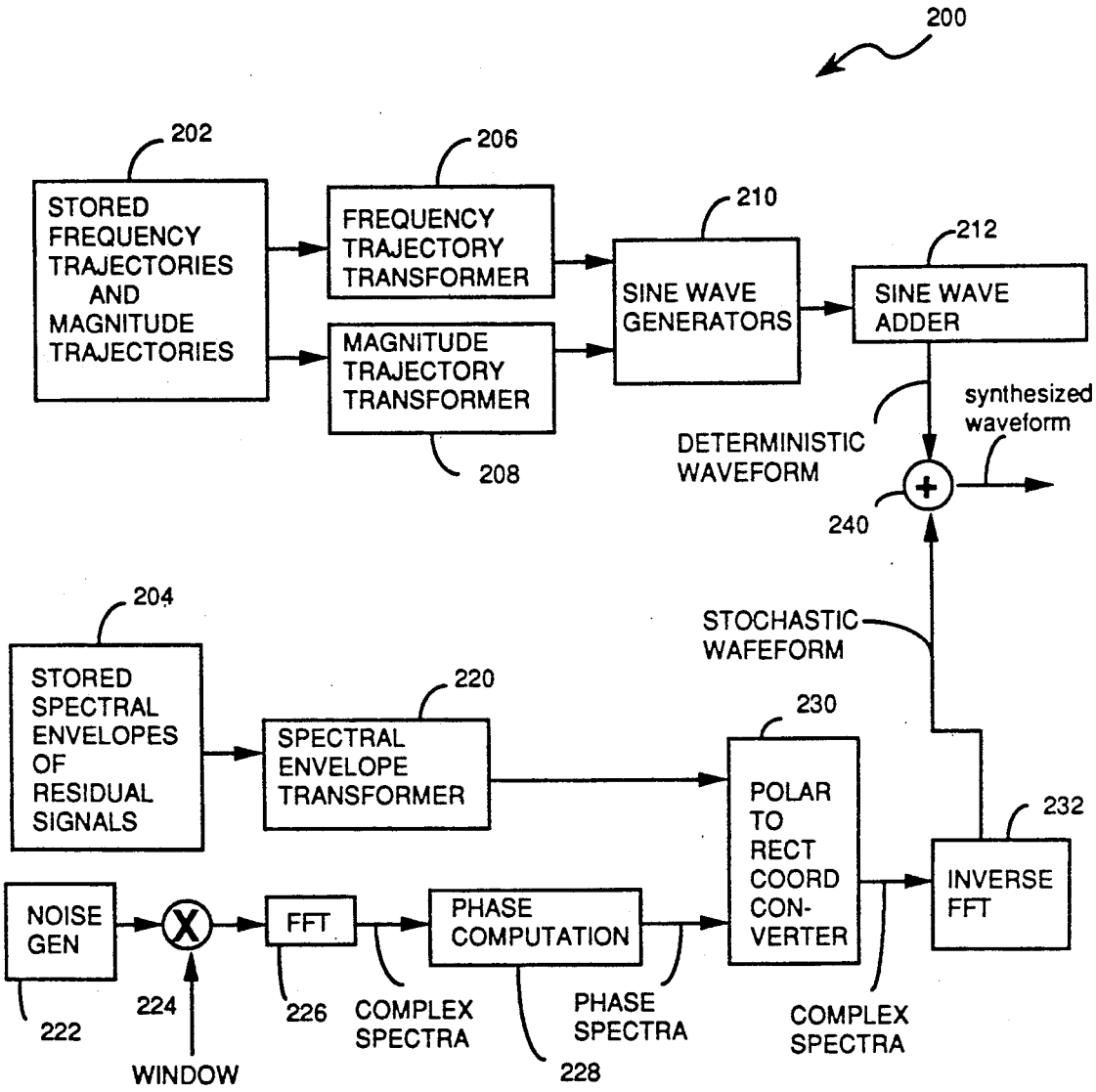
FIG. 2 is a block diagram of a musical sound synthesizer in accordance with the present invention.

FIG. 2 shows a sound synthesizer 200 in accordance with the present invention. Various sets of sound signals, as represented by the sound analyzer shown in FIG. 1, are stored in memories 202 and 204. Memory 202 stores pairs of magnitude and frequency trajectories, each pair representing a sound partial. Memory 204 stores residual spectral envelopes corresponding to the magnitude and frequency trajectories in memory 202.

More particularly, these memories 202 and 204 each store a series of values for producing sound signals in a corresponding series of time frames. Thus for each separate time frame there is a set of frequency and magnitude values stored in memory 202 which govern the deterministic waveform to be generated, and an spectral envelope (i.e., a set of frequency and magnitude values) is stored in memory 204 which governs the stochastic waveform to be generated.

The deterministic or sinusoidal component of the synthesized sound is generated using selected ones of the magnitude and frequency trajectories stored in memory 202. The trajectories may be transformed or manipulated by a frequency trajectory transformer 206 and a magnitude trajectory transformer 208. These transformers 206 and 208 may stretch a trajectory in time, perform linear or even nonlinear transformations, or may add, subtract and weight various partials from the database of partials in the memory 202. The transformers 206 and 208 alter the acoustic qualities of the deterministic waveform generated by the synthesizer 200, and thereby add to the range and quality of sounds that can be generated.

Of course, the original trajectories may be used untransformed. Each trajectory output by the transformers 206 and 280 is converted into a sine wave by one of a set of sine wave generators 210. Several sine wave generators are provided so that several partials can be generated simultaneously. These sine waves are combined by sine wave adder 212, resulting in the generation of the deterministic portion of the synthesized waveform.

The stochastic part of the synthesized sound is generated by creating a complex spectra out of the spectral envelope of the magnitude spectra residual, or its modification, and doing an inverse STFT. The stored spectral envelopes in memory 204 may be transformed by a spectral envelope transformer 220. The resulting envelope becomes the magnitude portion of the stochastic signal. The transformer 220 alters the acoustic qualities of the stochastic waveform generated by the synthesizer 200, and thereby adds to the range and quality of sounds that can be generated.

In order to generate the phase part of the spectrum for the stochastic signal, the STFT of a windowed white noise signal is computed using a noise generator 222, signal gate 224 for windowing or gating the noise signal, and an FFT 226. A phase generator converts the complex spectra output by the FFT into phase spectra values. These phase spectra and the magnitude values representing the spectral envelope are expressed in polar coordinates (i.e., real values). The polar coordinate values are converted into complex spectra by a polar-to-rectangular coordinate converter 230. The resulting complex spectra are then inverse Fourier transformed by an inverse-FFT 232 to generate the stochastic waveform. The process of generating the stochastic waveform corresponds to the filtering of white noise by a filter with a frequency response equal to the spectral envelope. Thus the stochastic signal circuitry 222–232 is essentially a white noise filter.

Finally, the stochastic and deterministic waveforms are added by adder 240 to generate the complete synthesized waveform. By proper selection of input trajectories and transformations, one can generate a very wide range of sounds using the synthesizer 200.

Second Preferred Embodiment of Signal Analyzer

Figure 3:
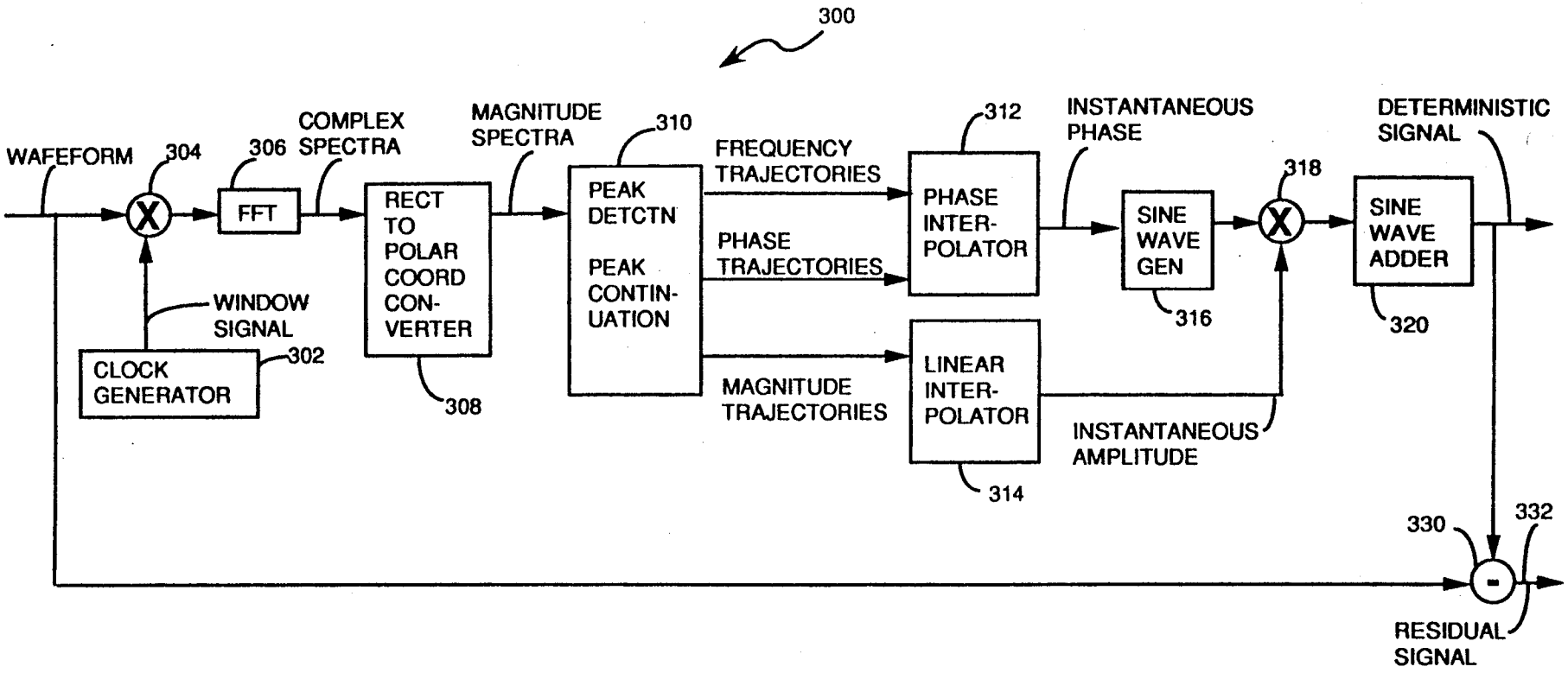
FIG. 3 is a block diagram of a second preferred embodiment of a musical sound analyzer in accordance with the present invention.

FIG. 3 shows a second and somewhat more complicated signal analyzer 300 than the one shown in FIG. 1. Like the signal model used by the first analyzer, the signal model used by this second analyzer assumes that the input sound s(t) is the sum o a series of sinusoids plus a noise signal e(t):

$$s(t) = \sum_{r=1}^{R} A_r(t)\cos\{\theta_r(t)\} + e(t) \quad \text{(Eq. 4)}$$

where R is the number of sinusoids used to represent the deterministic portion of the sound, $A_r(t)$ is the instantaneous amplitude and $\theta_r(t)$ is the instantaneous phase of each sinusoid. The residual signal e(t) is the difference between the signal and the sinusoidal or deterministic part.

However, in this model, the instantaneous phase is defined by $$\theta_r(t) = \int_0^t \omega_r(\sigma)d\sigma + \theta_r(0) + \phi_r \quad \text{(Eq. 5)}$$

where $\omega(t)$ is the frequency in radians, r is the sinusoid number, $\theta_r(0)$ is the initial phase value, and $\phi_r$ is a fixed phase offset.

A clock generator 302 generates a sequence of window signals which are used by gate 304 to divide the sound waveform into separate time frames. The time frames are analyzed by a fast Fourier Transformer (FFT) so as to generate a set of complex spectra values. The FFT 306 uses the short-time Fourier Transform, as described above with reference to FIG. 1.

A rectangular to polar coordinate converter 308 converts the complex spectra generated by the FFT 306 into a set of magnitude spectra for each time frame. Then a peak detector and sound partial analyzer 310 finds the highest peaks in the magnitude spectra and performs a parabolic interpolation to refine the frequency and amplitude values generated. Each identified peak has a frequency, phase and a magnitude value. The peaks from a series of time frames are then organized into sets of frequency, phase and magnitude trajectories, each set of which represents a sound partial. Thus the analyzer 310 extracts the stable sinusoids present in the original sound (the deterministic component). The frequency, phase and magnitude trajectories may be stored for use in a music synthesizer, as described above.

Next, the deterministic portion of the sound signal is regenerated by using a phase interpolator 312 to generate the instantaneous phase of the regenerated deterministic signal, and a linear interpolator 314 to generate the instantaneous magnitude of the regenerated deterministic signal. The instantaneous phase signal is used to control the shape of a sinusoidal signal generated by a sine wave generator 316, and then a multiplier 318 amplifies the resulting sine wave to match the amplitude indicated by the instantaneous amplitude output by interpolator 314. This waveform generation process is performed on several sound partials simultaneously by a corresponding number of interpolators 312–314, sine wave generators 316, and multipliers 318. These sound partials are combined by sine wave adder 320 to generate the deterministic element of the input waveform.

Finally, the deterministic signal is subtracted from the input waveform by subtractor 330 to generate a residual signal on line 332. Thus the deterministic and residual portions of the input signal have been separated, and these two, if recombined, will be perceptually indistinguishable from the input waveform. Further, the residual signal may be modeled as a stochastic signal using the same technique as in the first signal analyzer: by performing an STFT on the residual signal, computing the magnitude spectra, and then generating an envelope approximation of the magnitude spectra.

Second Preferred Embodiment of Sound Synthesizer

Figure 4:
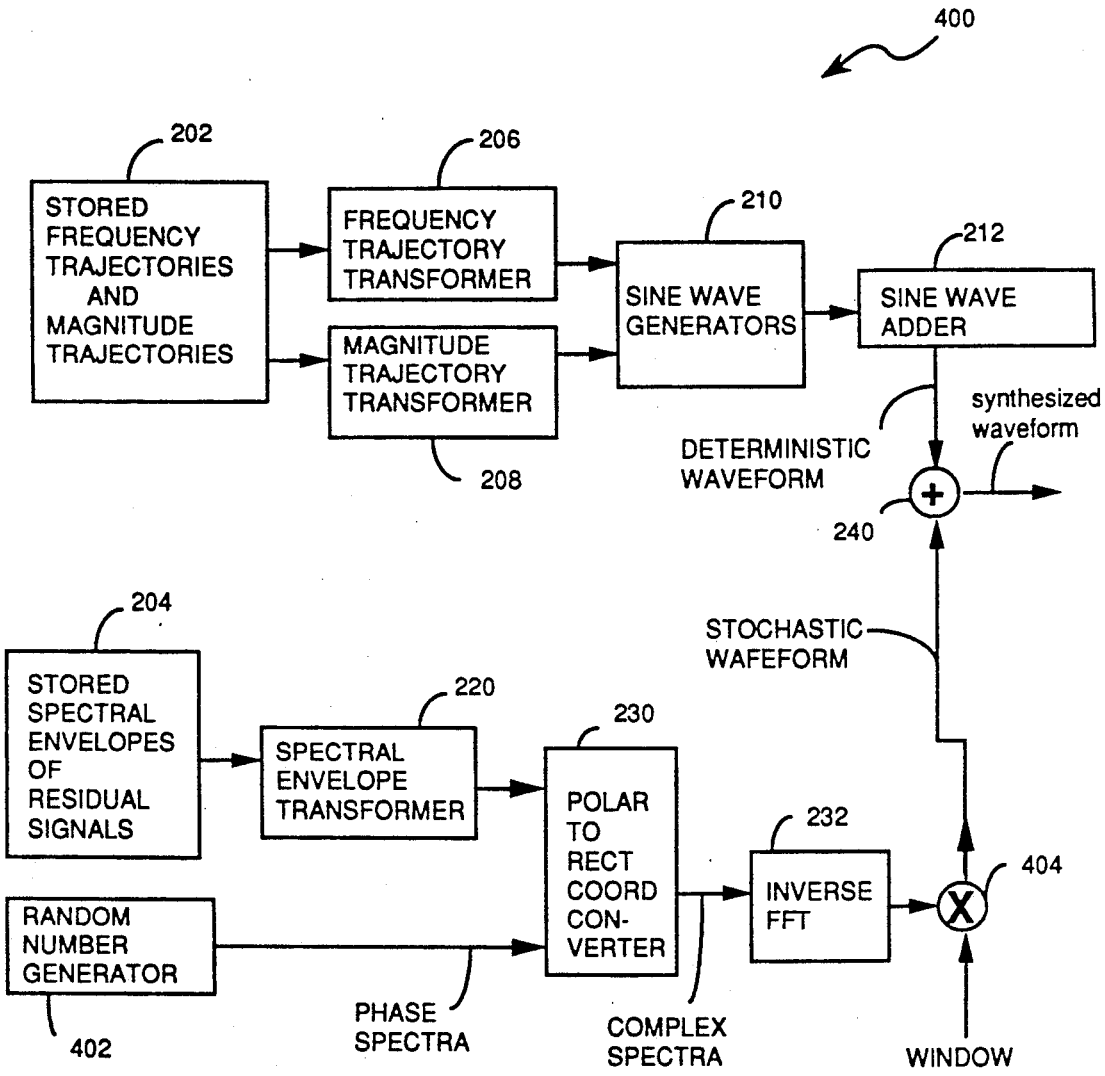
FIG. 4 is a block diagram of a second preferred embodiment of a musical sound synthesizer in accordance with the present invention.

FIG. 4 shows a second and somewhat simpler sound synthesizer 400 than the one shown in FIG. 2. In particular, synthesizer 400 uses the same apparatus for generating the deterministic portion of the synthesized sound as shown in FIG. 2; only the stochastic waveform circuitry has been changed from that shown in FIG. 2.

The noise generator circuitry 222–228 in FIG. 2 is replaced with a simple random number generator 402 that produces a set of phase values between $\pi$ and $-\pi$. In other words, for each time frame in which sound is to be synthesized, the random number generator 402 provides a set of values $\theta(k)$ each of which is equal to a randomly selected number between $\pi$ and $-\pi$, and where number of data points for each time frame corresponds to the number of input values needed by the inverse FFT 232. Similarly, the spectral envelope transformer 220 provides a set of interpolated values A(k) which represent the interpolated magnitudes of the spectral envelope at each of the data points (i.e., frequency points) needed by the inverse FFT 252. These interpolated values are calculated from the stored spectral envelope obtain from memory 204. Note that frequency magnitudes in the stored spectral envelope from memory 204 may not correspond exactly to the data points needed by the inverse FFT 232, requiring the calculation of interpolated values for those data points.

Together, the random number generator 402 and the transformer 220 provide a set values $\{A(1),\theta(1)\}$, $\{A(2),\theta(2)\}$, $\{A(n),\theta(n)\}$, where n is the number of data points needed by the inverse FFT 232.

Next, the values for each time frame are converted from polar coordinates to rectangular coordinates by converter 230, because the inverse FFT 232 requires complex data values as its input values. The resulting complex spectra are converted into a sequence of sampled data values by an inverse FFT 232. These sampled data values are the time domain signal that represents the stochastic part of the synthesized signal for one time domain.

However, to provide for smooth transitions between time frames, the data samples generated by the inverse FFT 232 are windowed by a windowing buffer 404. This windowing buffer 404 typically overlaps and mathematically adds data samples from neighboring windows (i.e., time frames) with appropriate weighting factors. For example, the time domain data samples for each time frame could be used for four time frames, with the values output from by the windowing buffer 404 being equal to one fourth of the data sample values from the current time frame, plus one fourth of the data sample values from the previous three time frames. In another embodiment the weighting factors could correspond to a Gaussian or a Hanning window.

The resulting data values output by the windowing buffer 404 comprise a stochastic waveform that is combined with the deterministic waveform to form a synthesized waveform.

The noise synthesis system and method shown in FIG. 4 is very flexible in terms of being able to manipulate the shape of the stochastic waveform and is easier to implement in a real time system than the synthesizer of FIG. 2 because the FFT 226 in FIG. 2 has been eliminated.

Third Preferred Embodiment of Sound Synthesizer

Figure 5:
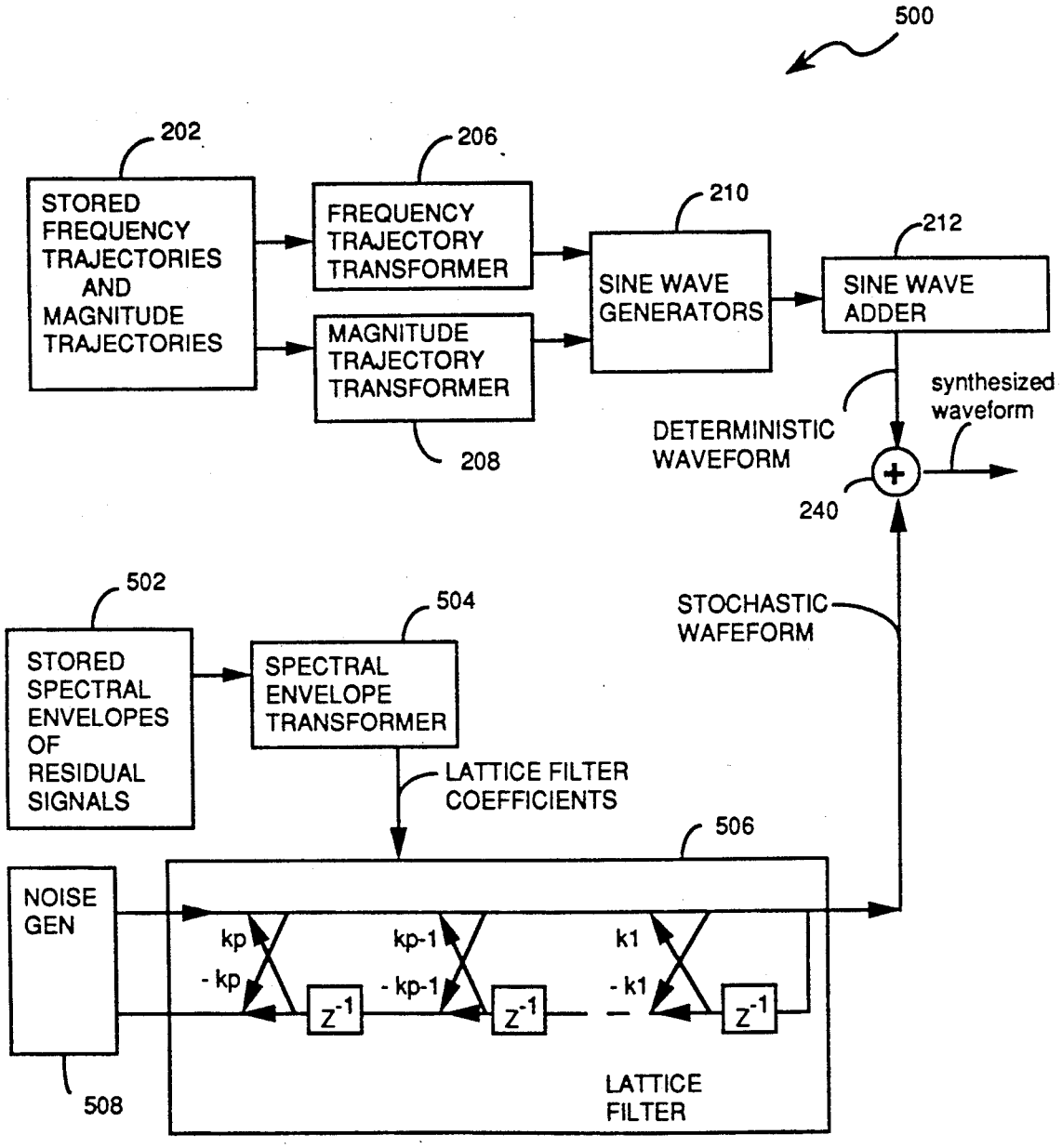
FIG. 5 is a block diagram of a third preferred embodiment of a musical sound synthesizer in accordance with the present invention.

FIG. 5 shows a third and even simpler sound-synthesizer 500 than the ones shown in FIGS. 2 and 4. In the previous embodiments, the spectral envelopes for the residual signals were effectively represented by a line segment approximation of the spectral envelope. This is because the spectral envelopes were represented by a set of magnitude values for a number of discrete frequency values. In a typical implementation of the synthesizer in FIG. 4, a set of perhaps fifteen values would be stored to represent the magnitude of the spectral envelope at fifteen frequencies. The remainder of the spectral envelope is formed or computed by linearly interpolating between the stored values.

In this synthesizer 500, the spectral envelope is represented using a LPC (linear predictive coding) model instead of a set of magnitude values. As is well known to those skilled in the art, any spectral envelope can be approximated or represented by a set of LPC coefficients. Furthermore, any set of LPC coefficients, which correspond to an all-pole filter (also known as an IIR or infinite impulse response filter), can be converted into lattice filter coefficients using well known conversion algorithms. See, for example, Markel, J. D. and Gray, A. H. Linear Prediction of Speech, Springer-Verlag, New York (1976), which is hereby incorporated by reference.

Thus, in FIG. 5, memory 502 stores the spectral envelopes for each of a series of time frames in the form of lattice filter coefficients (shown as kl through kp if FIG. 5). One advantage of storing a spectral envelope in the form of lattice filter coefficients is that less data points are needed (i.e., for each time frame), and therefore less storage is required. Transformer 504 performs a windowing type of function by interpolating the lattice coefficient values between time frames so as to provide smooth transitions over time. The resulting lattice coefficients are loaded into a lattice filter 506. The lattice filter 506 filters white noise generated by a noise generator 508 and outputs the stochastic waveform that is combined with the deterministic waveform to form a synthesized waveform.

This embodiment of the present invention has the advantage of requiring less data storage than the other embodiments, and also substitutes a lattice filter for the inverse FFT in those embodiments, all of which makes this embodiment less expensive and simpler to implement that the other embodiments. The primary tradeoff is that this embodiment is less flexible in terms of its ability to manipulate the stored spectral envelopes for generating a modified stochastic waveform.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A sound waveform synthesizer, comprising:

storage means for storing data denoting a sequence of sound partials and data denoting a corresponding sequence of spectral envelopes;

sinusoidal waveform generator means coupled to said storage means for generating a sequence of first waveforms during a sequence of time frames, including means for generating sinusoidal waveforms during each said time frame corresponding to a selected one of said sound partials denoted by data stored in said storage means;

stochastic waveform generator means coupled to said storage means for generating a sequence of stochastic waveforms during said sequence of time frames, including means for generating stochastic waveforms during each said time frame having a spectral envelope corresponding to a selected one of said spectral envelopes denoted by data stored in said storage means; and means for generating a synthesized sound waveform, including means for combining said first waveforms and said stochastic waveforms;

said stochastic waveform generator means including noise generating means for generating a noise signal; and filter means coupled to said storage means and said noise generating means for generating a stochastic waveform, including means for filtering said noise signal with a time varying frequency response during said sequence of time frames, said frequency response during each said time frame corresponding to a selected one of said spectral envelopes denoted by data stored in said storage means.

2. A sound waveform synthesizer as set forth in claim 1, wherein said data denoting a sequence of spectral envelopes includes data denoting a set of lattice filter coefficients for each of a sequence of time frames;

said filter means in said stochastic waveform generator means comprising lattice filter means for filtering said noise signal with a time varying frequency response during said sequence of time frames, said frequency response during each said time frame corresponding to a selected one of said sets of lattice filter coefficients denoted by data storage in said storage means.

3. A sound waveform synthesizer as set forth in claim 1, said noise generating means comprising random number generating means for generating a set of random phase values for each said time frame;

said filter means including:

stochastic spectra means for generating a set of complex spectral values for each said time frame, including means for combining said set of random phase values for each said time frame with a selected one of said spectral envelopes denoted by data stored in said storage means; and inverse Fourier transform means coupled to said stochastic spectra means for generating a stochastic waveform for each said time frame by inverse fourier transforming said complex spectral values.

4. A sound waveform synthesizer as set forth in claim 1, further including transform means coupling said storage means with said sinusoidal waveform generator means, including means for transforming selected ones of said sound partials stored in said trajectory storage means, thereby altering the acoustic qualities of said sequence of first waveforms.

5. A sound waveform synthesizer as set forth in claim 1, further including envelope transform means coupling said storage means with said stochastic waveform generator means, including means for transforming selected ones of said spectral envelopes stored in said storage means, thereby altering the acoustic qualities of said sequence of stochastic waveforms.

6. A sound waveform synthesizer, comprising:

trajectory storage means for storing sound partials, including means for storing corresponding sets of magnitude and frequency trajectories, each set representing a sound partial;

envelope storage means for storing spectral envelopes, each spectral envelope corresponding to the stochastic portion of a predefined sound;

sinusoidal waveform generator means coupled to said trajectory storage means for generating a first waveform corresponding to selected sound partials stored in said trajectory storage means;

noise generating means for generating a noise signal;

filter means coupled to said envelope storage means and said noise generating means for generating a stochastic waveform, including means for filtering said noise signal with a frequency response equal to a selected spectral envelope stored in said envelope storage means; and means for generating a synthesized sound waveform, including means for combining said first waveform and said stochastic waveform.

7. A sound waveform synthesizer as set forth in claim 6, further including transform means coupling said trajectory storage means with said sinusoidal waveform generator means, including means for transforming selected ones of said sound partials stored in said trajectory storage means, thereby altering the acoustic qualities of said first waveform.

8. A sound waveform synthesizer as set forth in claim 6, further including envelope transform means coupling said envelope storage means with said filter means, including means for transforming selected ones of said spectral envelopes stored in said envelope storage means, thereby altering the acoustic qualities of said stochastic waveform.

9. A method of generating sound waveforms, the steps of the method comprising:

storing data denoting a sequence of sound partials and data denoting a corresponding sequence of spectral envelopes;

generating a sequence of first waveforms during a sequence of time frames, including generating a plurality of sinusoidal waveforms during each said time frame corresponding to a selected one of said stored sound partials; and generating a sequence of stochastic waveforms during said sequence of time frames, including generating stochastic waveforms during each said time frame having a spectral envelope corresponding to a selected one of said stored spectral envelopes; and combining said first waveforms and said stochastic waveforms to generate a synthesized sound waveform;

said second generating step including the steps of generating a noise signal; and filtering said noise signal with a time varying frequency response during said sequence of time frames, said frequency response during each said time frame corresponding to a selected one of said stored spectral envelopes.

10. A method of generating sound waveforms, as set forth in claim 9, wherein said stored data denoting a sequence of spectral envelopes includes data denoting a set of lattice filter coefficients for each of a sequence of time frames;

said noise filtering step including the step of filtering said noise signal with a lattice filter employing time varying lattice filter coefficients corresponding to a sequence of said sets of lattice filter coefficients.

11. A method of generating sound waveforms, as set forth in claim 9, said second generating step including the steps of:

said noise generating step including generating a set of random phase values for each said time frame;

said noise filtering step including the steps of:

generating a set of complex spectral values by combining said set of random phase values for each said time frame with a selected one of said spectral envelopes denoted by said stored data; and inverse fourier transforming said complex spectral values for each said time frame.

12. A method of generating sound waveforms, as set forth in claim 9, said first generating step including the step of transforming selected ones of said stored sound partials and thereby altering the acoustic qualities of said sequence of first waveforms.

13. A method of generating sound waveforms, as set forth in claim 9, said second generating step including the step of transforming selected ones of said stored spectral envelopes and thereby altering the acoustic qualities of said sequence of stochastic waveforms.

14. A sound waveform synthesizer, comprising:

storage means for storing data denoting a sequence of sound partials and data denoting a corresponding sequence of spectral envelopes;

sinusoidal component generator means coupled to said storage means for generating a sequence of sinusoidal waveform components during a sequence of time frames, including means for generating sinusoidal waveform components during each of said time frame corresponding to a selected one of said sound partials denoted by data stored in said storage means;

stochastic component generator means coupled to said storage means for generating a sequence of stochastic waveform components during said sequence of time frames, including means for generating stochastic waveform components during each said time frame having a spectral envelope corresponding to a selected one of said spectral envelopes denoted by data stored in said storage means; and means for generating a synthesized sound waveform, including means for combining said sinusoidal waverform and stochastic waveform components;

said stochastic component generator means including:

noise generating means for generating a noise signal; and noise shaping means coupled to said storage means and said noise generating means for combining said noise signal with selected ones of said spectral envelopes denoted by data stored in said storage means so as to generate spectrally shaped stochastic waveform components.

15. A sound waveform synthesizer as set forth in claim 14, wherein said noise shaping means comprises inverse fourier transforming means for generating a stochastic waveform for each said time frame by inverse fourier transforming said noise signal combined with selected ones of said spectral envelopes.

16. A sound waveform synthesizer as set forth in claim 14, further including transform means coupling said storage means with said sinusoidal waveform generator means, including means for transforming selected ones of said sound partials stored in said trajectory storage means, thereby altering the acoustic qualities of said sequence of first waveforms.

17. A sound waveform synthesizer as set forth in claim 14, further including envelope transform means coupling said storage means with said stochastic waveform generator means, including means for transforming selected ones of said spectral envelopes stored in said storage means, thereby altering the acoustic qualities of said sequence of stochastic waveforms.

* * * * *